United States Patent [19]

Nabucet et al.

[11] 4,108,071

[45] Aug. 22, 1978

[54] CUTTING DEVICE HAVING A SHAPED CHARGE IN A CAVITY OF REVOLUTION

[76] Inventors: Georges Joseph Nabucet, 19, rue du Gué Fleuri, Le Relecq Kerhuon; Michel André Champ, 35 rue Erwan Marec, Brest, both of France

[21] Appl. No.: 698,797

[22] Filed: Jun. 22, 1976

[51] Int. Cl.[2] ..... F42B 3/08

[52] U.S. Cl. ..... 102/24 HC; 114/221 A

[58] Field of Search ..... 102/24 HC; 89/1 B; 114/221 A

[56] References Cited

U.S. PATENT DOCUMENTS 3,773,009 11/1973 Pecksen ..... 114/221 A

FOREIGN PATENT DOCUMENTS 1,124,550 7/1956 France ..... 102/24 HC

*Primary Examiner*—Verlin R. Pendegrass

*Attorney, Agent, or Firm*—Haseltine, Lake & Waters

[57] ABSTRACT

A cutting device for producing a cutting jet from a shaped charge in a cavity of revolution comprising a body provided with a blind hole of revolution constituted from the bottom by a cylindrical-conical portion whose conical surface is defined by a conical liner surmounted by cylindrical portions of different diameters for supporting a member of revolution having two channels parallel to the axis of the blind hole. A tubular space is formed above the channels and the channels and the space between the member of revolution and the liner are filled with explosive, the tubular space being surmounted by a detonator. The plane of the two channels define the direction of the cutting jet.

8 Claims, 4 Drawing Figures

CUTTING DEVICE HAVING A SHAPED CHARGE IN A CAVITY OF REVOLUTION

FIELD OF THE INVENTION

The present invention relates to a pyrotechnical device for cutting mechanical connection means and particularly cable. It relates more particularly to such a device adapted to be utilized at the bottom of a seabed, possibly at great depth, but it is obviously not limited to this utilization.

PRIOR ART

Already known are devices for cutting cable or rope comprising explosive bolts. Such devices are notably described in French Pat. Nos. 1,194,826, 1,238,176 and 1,390,760. Conventional destructive charges separate the bolts into two parts along rupture initiation zones. At great depth, due to the large pressures applied, it is necessary to make the charges and the walls of the bolts oversize in excessive manner which considerably increases the risk in the event of inopportune operation outside of the water.

To avoid these disadvantages, an object of this invention consists in the provision of a device for cutting cable comprising a shaped charge.

Shaped charges having their cavities directed towards the object and preferably provided with a coating produce, after ignition, a perforation effect even on the hardest of materials. More precisely, cutting or separating shaped charges are known which are characterized by a cavity in the form of a channel or dihedron whose detonation produces along the length of the plane of symmetry of the channel or dihedron a relatively narrow groove in the target material and a length of the order of that of the charge. However, such dihedric charges present difficulties in use and are relatively cumbersome as one portion of the charge, which is not negligible, serves only to give to the jet its cutting shape.

Also known are shaped cutting charges in which there is utilized a charge of revolution with an asymmetrical cavity such as those described in French Pat. No. 1,599,650. However, these charges are difficult to produce which limits their utilization.

Further known are shaped cutting charges having a charge and cavity of revolution in which are utilized devices for igniting the charge at two diametrically opposed points as is described in French Pat. No. 1,359,513. However, the realization of this charge necessitates the provision of holes in the mass of the charge to receive the extremities of the igniting devices which also increases the difficulties as regards the manufacture as well as the simultaneous detonation of the two igniting points with an extremely reduced tolerance of the time intervals.

SUMMARY OF THE INVENTION

An object of the present invention consists in the provision of a shaped cutting charge having a cavity of revolution but which does not have the disadvantage mentioned hereinabove.

According to a characteristic feature of the present invention, there is provided a device having a shaped cutting charge comprising a body having relatively high mechanical resistance in which is provided a blind hole of revolution comprising at the bottom a first cylindrical-conical portion having a first bore, above the said first portion, a second and third portion serving to support a member of revolution having two cylindrical channels opening on the one hand, in the second portion, and on the other hand, in a tube provided in the said member, the channels being symmetrical with respect to a common axis of the blind hole and the cone, the dish, the channels and the second portion above the cone being filled with explosive which can be the same as that constituting the charge of which the cone is the lining, the tube being mounted on a detonator, the plane of the two channels defining the direction of the cutting jet generated by the firing of the shaped charge.

According to another characteristic feature, beyond the bottom of the first portion, the body comprises a second hole whose direction is perpendicular to the plane of the two channels and in which is placed the cable or the rod to be cut, the second hole being at a distance from the bottom of the said first portion such that it must be traversed by the said cutting jet.

According to another characteristic feature, at each one of its extremities, the second hole is flared which permits simple escape of the two ends of the cable or of the rod cut by the said cutting jet which also avoids certain phenomena of corrosion and which permits, in the case of a cable, proper formation of its loop.

According to another characteristic feature, beyond the second flared hole, the body has a massive base whose thickness is sufficient to absorb the cutting jet and for concentrating thereat all of the remaining destructive effects after cutting of the cable or of the rod.

According to another characteristic feature, the said blind hole additionally comprises above the said third portion, a fourth cylindrical portion, the shoulder between the third portion and the fourth portion of much greater diameter being provided with a second relatively short blind bore whose axis is in the plane of the two channels, the said member of revolution comprising around the tube a cylindrical base of a diameter slightly less than the bore of the fourth portion and carrying a lug penetrating in the said second hole to suitably orient the said member of revolution in the said body.

According to another characteristic feature, the said base of the member of revolution is surmounted by a hub having an external cylindrical surface whose diameter, with necessary close clearance, is practically equal to that of the fourth portion, the said hub being tightly engaged against the said base by suitable means and carrying the said detonator in its central portion.

According to another characteristic feature, the bottom of the said first portion is conical.

According to another characteristic feature, the said shaped charge device is retained at the bottom of the sea by a cable or a rod passing in the said second hole and is solid with an installation having positive floatability and comprising between one another means for control of said detonator.

BRIEF DESCRIPTION OF THE DRAWINGS

Other characteristics of the present invention will appear more clearly from a reading of the following description of one embodiment, the said description being taken in conjunction with the attached drawings, in which.

DETAILED DESCRIPTION

Figure 1:
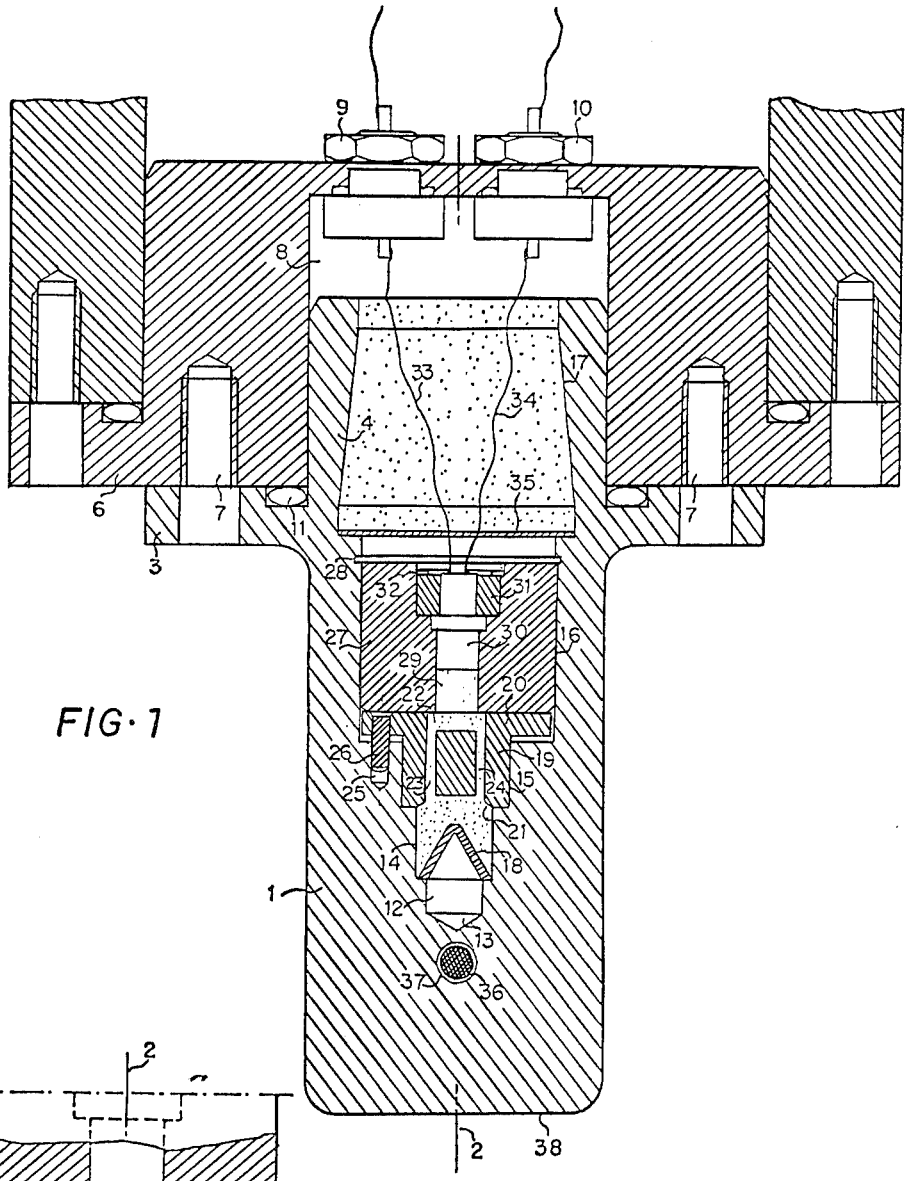
FIG. 1 is an axial section of a device having an axial shaped charge according to the invention.

The device in FIG. 1 comprises a metallic body 1, for example, of stainless steel or of titanium, having high mechanical resistance, whose general exterior surface is cylindrical around the axis 2 and whose upper portion is prolonged, on the one hand, by a flange 3 and on the other hand, by a mouth 4 of generally cylindrical exterior surface. The flange 3 permits attachment of the body 1 to an intermediary member 6 by means of bolts threaded in tapped holes 7. The member 6 has a cylindrical hollow 8 in which is mounted the mouth 4 and water-tight electrical connectors 9 and 10. An O-ring 11 effects a water-tight seal between body 1 and member 6.

The body 1 has a blind hole comprising a cylindrical portion 12 terminated by a conical portion 13 formed in the course of drilling 12, a cylindrical portion 14 above 12, a cylindrical portion 15 above 14, a cylindrical portion 16 above 15, and a frusto-conical portion 17 above 16 in the mouth 4. The frusto-conical portion 17 whose larger base faces 16 has, in the region of its bases, cylindrical portions of relatively small height. The portions 12 to 17 are all portions of revolution around the axis 2. The portions 12 to 16 have increasing diameters as shown in FIG. 1.

The shoulder existing between 12 and 14 supports the base of a hollow cone 18 of dense material, for example, of copper or uranium, serving in conventional manner to define the hollow volume of the shaped charge. In the cylinder 15 is mounted a member 19 comprising a cylindrical body of revolution whose diameter is substantially equal to that of 15 and a base 20 of reduced height whose diameter is slightly smaller than that of 16. The member 19 is metallic, for example, of light weight alloy. Facing cylinder 14 and above the cone 18 the body of the member 19 has a hollow 21 chamfered from the shoulder between 14 and 15. The base 20 has an axial tube 22 facing cylinder 16. The thickness of the base 20 is such that it does not rest on the shoulder existing between 15 and 16 in order that the bottom of the body of 19 rests on the shoulder existing between 14 and 15. The body of the member 19 is provided with two cylindrical channels 23 and 24 having axes parallel to axis 2 and opening, on the one hand, in the tube 22 and on the other hand, in the hollow 21. The channels 23 and 24 are symmetrically disposed with respect to the axis 2.

The cavity formed by the tube 22, the channels 23 and 24, the hollow 21 and the portion 14 above the cone 18 is filled with explosive, the lower portion of this charge forming the shaped charge itself. The detonator 29 ignites the explosive in the tube 22. The detonation is propagated in the channels 23 and 24 in a manner to ignite the shaped charge itself at two diametrically opposed points exactly at the same instant. As a result thereof, there is generated a planar perforating jet or more particularly a cutting jet whose plane is that of the channels 23 and 24 as this is described in part in the previous French Pat. No. 1,359,513. It will immediately appear to one skilled in the art that the utilization of the member 19 having the two channels 23 and 24 advantageously replaces igniting of the charge at two points. The distance between the two axes of the channels 23 and 24 is obviously a function of the size of the hollow charge, of its diameter, of the height of the cone 18, and of the length of the notch that one wishes to obtain.

The shoulder existing between 15 and 16 is provided with a blind hole 25 in which is placed an alignment lug 26 secured to the base 20. At the time of mounting of member 19 in the portion 15 and 16, the lug 26 is engaged in 25 which assures the proper position of the channels 23 and 24, that is to say, of the notch to be produced.

Above the base 20 is applied a hub 27 preferably metallic which is mounted with slight friction in the cylinder 16. The hub 27 is locked against the base 20 by a split washer 28 which is mounted in a slot provided for this purpose in the lateral surface of the cylinder 16. In a central cavity of hub 27 having the same axis as 27 is mounted electronic detonator 29 and its feed means 30. The means 30 is locked against the detonator 29, itself in contact with the explosive in the tube 22 by means of a sleeve 31 fixed by a split washer 32. Two electrical conductors 33 and 34 respectively connect the terminals of the feed 30 with the contacts 9 and 10.

The internal portion of the mouth 4 is separated from the mass of 16 surmounting 32 by a thin partition 35 through which the conductors 33 and 34 pass. This internal portion of 4 is filled with a resin to form in sealed manner the blind hole 12–17 and to avoid any projection of possible flame on the feed system which can thus be recovered. The resin could be replaced by a metallic stopper.

The mounting of the different portions of the charge in the hole of the body 1 is deduced in a manner obvious to one skilled in the art from the description which has proceeded.

When as in the example of the described embodiment, the charge with cutting effect is adapted to shear a cable or a rod, the body 1 comprises further a hole 36 in which the cable or the rod 37 to be cut is mounted. The axis of the hole 36 is, in a plane perpendicular to that of the channels 23 and 24 along the length of the axis 2, preferably perpendicular to this axis 2, at the intersection therewith. The perforation realized by the cutting jet does not only reach the cable 37, but also the space of the body 1 between the hole 36 and the cone 13 as well as a certain portion of the body 1 situated behind the cable 37 with respect to the charge to shear the cable 37 with certainty. In this regard, the thickness of the body 1 between the hole 36 and the lower surface 38 must be sufficient to absorb all of the energy at the time of the detonation of the shaped charge and whether cable 37 is present or not in order that the cutting jet does not pass through base 38. Thus, the risk in the case of inopportune operation outside of the water is practically eliminated, the other extremity of the apparatus being closed by the stopper of resin or of metal.

Figure 2:
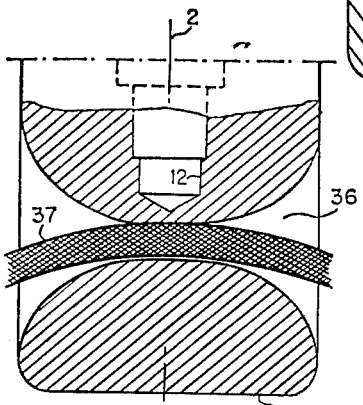
FIG. 2 is another axial section partially of the device of FIG. 1 but taken along a plane perpendicular to the plane therein.

The section in FIG. 2 taken on a plane perpendicular to that of the section of FIG. 1 shows how the hole 36 is flared at its two ends towards its exterior. This flared form avoids certain phenomena of corrosion appearing especially in acute angles; it permits giving a suitable form to the loop of the cable when this is connected to a ballast as will be seen in relation to FIG. 3. Finally, it facilitates the escape of each of the ends of the cable when this has been cut by the cutting jet.

Figure 3:
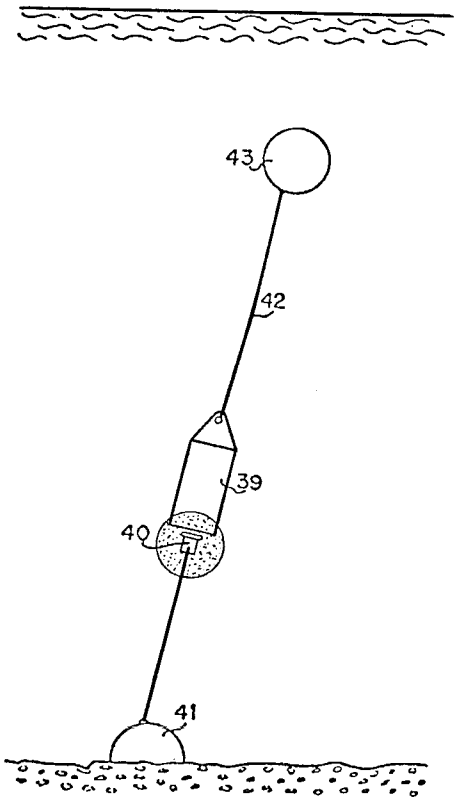
FIG. 3 is a schematic view of an installation anchored to the bottom of the sea and comprising a device according to the invention.

FIG. 3 schematically shows an installation 39 anchored to the bottom of the sea and comprising a device 40 such as that in FIGS. 1 and 2 at its lower portion. The device 40 is connected by a cable 37 to an anchor 41. Furthermore, the installation 39 is urged upwardly by a highly positive floating device 43 to which it is connected by a line 42. The device 40 is connected to the installation 39 by bolts threaded in the tapped holes 7, FIG. 1. It can be assumed, for example, that the installation 39 is capable at a given instant, pre-adjusted in advance or determined by a signal received from the surface of the water to feed the contacts 9 and 10 to actuate electrical detonator 29 which ignites the shaped charge. The cable 37 is thus cut and the assembly 39 rises to the surface to be generally recovered thereat.

Figure 4:
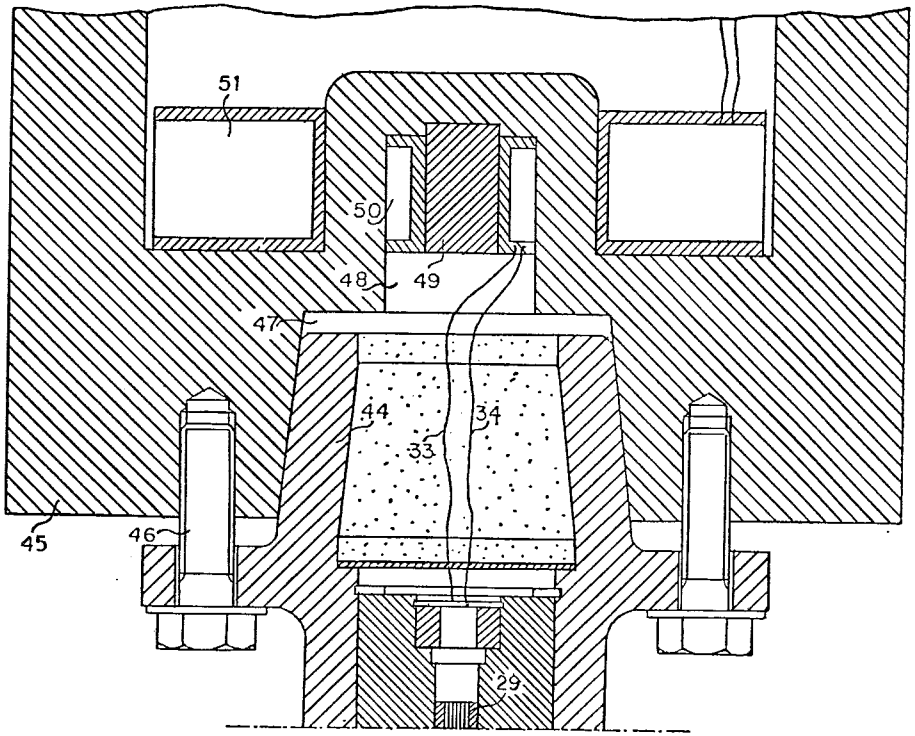
FIG. 4 is an axial section of a variation of a shaped charge device according to the invention.

FIG. 4 shows a modification of the device 40 of FIGS. 1 and 2 in which the mouth 4 with its exterior cylindrical surface is replaced by a mouth 44 having an external conical surface, the intermediate member 6 being eliminated and the flange 3 being directly screwed to the base of installation 45 similar to 39 by bolts 46. The base of 45 has a hole 47 whose conicity is the same as that of 44 in a manner that by tightening the bolts 46, there is obtained a perfectly sealed connection between 44 and 47.

Furthermore, the bottom of the hole 47 additionally comprises a cylindrical chamber 48 having a central stem 49 on which is mounted an electrical coil 50. The assembly of the coils 51 and 50 constitutes a transformer of which 51 is the primary and 50 the secondary. The terminals of the coil 50 are connected by the conductors 33 and 34 to the detonator 29. In this variation there is an absolute sealed relation between the interior 45 and the device with the shaped charge and, in particular, there is avoided the utilization of connectors such as 9 and 10.

It will be well understood that the application described of the apparatus for cutting cables or rods is not limitative. Thus, below the conical portion 13, FIG. 1, one can provide a plane horizontal face of the body 1 at the level of the hole 36. This face can be thus applied by suitable means on the portion to be cut.

Of course, the principles of the present invention have been described above in relation to particular embodiments, it being understood that this description has only been given by way of example and does not limit the scope of the invention.

We claim:

1. A device having a shaped charge comprising a cone-shaped liner generating a planar perforating jet, said charge being provided with a cavity of revolution and comprising a body having relatively high mechanical resistance in which is provided a blind hole of revolution comprising at the bottom a first cylindrical-conical portion having a first bore, above the said first portion, a second and a third portion serving to support a member of revolution having two cylindrical channels opening, on the one hand in the second portion and on the other hand in a tube provided in the said member, the channels being symmetrical with respect to the common axis of the blind hole and the cone-shaped liner, the tube, the channels and the second portion above the cone-shaped liner being filled with explosive which can be the same as that constituting the charge whose cone-shaped liner is its lining, the tube being surmounted by a detonator, the plane of the two channels defining the direction of the cutting jet generated by the detonation of the shaped charge.

2. Apparatus according to claim 1 wherein beyond the bottom of the first portion, the body comprises a second hole whose direction is perpendicular to the plane of the two channels and in which is placed the cable or the rod to be cut, the second hole being at a distance from the bottom of the first portion such that it must be traversed by the said cutting jet.

3. Apparatus according to claim 2 wherein at each of its extremities the second hole is flared which permits a simple escape of the two ends of the cable or of the rod cut by the said cutting jet which also avoids certain phenomena of corrosion and which permits in the case of a cable the proper formation of its loop.

4. Apparatus according to claim 3 wherein beyond the second hole the body has a massive bottom whose thickness is sufficient to absorb the cutting jet and to concentrate thereat all of the destructive residual effects after the cutting of the cable or of the rod.

5. Apparatus according to one of claim 4 wherein the said blind hole further comprises above the said third portion a fourth cylindrical portion, the shoulder between the third portion and the fourth portion of greater bore being provided with a second relatively short blind hole whose axis is in the plane of the two channels, the said member of revolution comprising around the tube a cylindrical base of diameter slightly less than the bore of the fourth portion and carrying a lug penetrating in the said second hole to suitably orient the said member of revolution in the said body.

6. Apparatus according to claim 5 wherein the said base of the member of revolution is surmounted by a hub having an exterior cylindrical surface such that the diameter, with small necessary clearance, is practically equal to that of the fourth portion, the said hub being tightly engaged against the said base by suitable means and carrying in its central portion the said detonator.

7. Apparatus according to claim 6 wherein that the bottom of the said first portion is conical.

8. Apparatus according to claim 7 wherein the said device having the shaped charge is retained at the bottom of the sea by a cable or rod passing in the said second hole and is solid with an installation having positive floatability comprising between one another means for control of the detonator.

* * * * *